US006796049B1

(12) United States Patent
Claxton

(10) Patent No.: US 6,796,049 B1
(45) Date of Patent: Sep. 28, 2004

(54) ADJUSTABLE TILE SPACING APPARATUS

(76) Inventor: Curtis A. E. Claxton, P.O. Box 276 Kingshill, St. Croix, VI (US) 00851

( * ) Notice: Subject to any disclaimer, the term of this patent is extended or adjusted under 35 U.S.C. 154(b) by 0 days.

(21) Appl. No.: 10/391,150

(22) Filed: Mar. 18, 2003

(51) Int. Cl.[7] ..... G01B 3/30
(52) U.S. Cl. ..... 33/527
(58) Field of Search ..... 33/526, 527, 472

(56) References Cited

U.S. PATENT DOCUMENTS

| | | | | | |
|---|---|---|---|---|---|
| 2,770,043 | A | * | 11/1956 | Kwiecinski | 33/452 |
| 3,183,598 | A | * | 5/1965 | Charles | 33/527 |
| 4,088,290 | A | * | 5/1978 | Novello | 33/403 |
| 4,860,723 | A | * | 8/1989 | Fortin | 33/526 |
| 5,038,490 | A | * | 8/1991 | Armstrong | 33/527 |
| 5,359,783 | A | * | 11/1994 | Smith | 33/527 |
| 5,471,758 | A | * | 12/1995 | White, Sr. | 33/527 |
| 5,701,680 | A | * | 12/1997 | Garcia et al. | 33/526 |
| 5,768,793 | A | * | 6/1998 | Fields | 33/526 |
| 5,832,619 | A | * | 11/1998 | Volkema, Jr. | 33/527 |
| 6,101,730 | A | * | 8/2000 | Marino | 33/526 |
| 6,131,972 | A | * | 10/2000 | Whitehead et al. | 294/57 |
| 6,195,904 | B1 | * | 3/2001 | Greer | 33/527 |
| 6,481,112 | B1 | * | 11/2002 | White | 33/527 |

* cited by examiner

*Primary Examiner*—Christopher W. Fulton
*Assistant Examiner*—Yaritza Guadalupe
(74) *Attorney, Agent, or Firm*—John D. Gugliotta; P. Jeff Martin; Olen L. York, III

(57) ABSTRACT

An adjustable tile spacing apparatus permits the setting tiles in a consistent pattern with perfect spacing relative to one another so as to obtain grout joints of uniform width. The adjustable tile spacing apparatus includes a central member and two perpendicular members at opposing ends of the central member, with each member adjustable in both width and length dimensions, via the use of telescoping members and fasteners. A spacer is affixed to each corner of the apparatus. The spacer can have an X-shape, a T-shape, an L-shape, or a linear shape. The spacers may be ¼ inch, ⅜ inch, and ⅛ inch in width to construct various sized grout line widths. A rubber handle with finger grips is provided for user comfort. The adjustable tile spacing apparatus is simply moved along as each tile is set and provides perfect spacing for the next tile to be set.

20 Claims, 6 Drawing Sheets

ADJUSTABLE TILE SPACING APPARATUS

RELATED APPLICATIONS

The present invention was first described in U.S. Ser. No. 09/736,485, filed on Dec. 13, 2000, herein abandoned.

BACKGROUND OF THE INVENTION

1. Field of the Invention

The present invention relates generally to devices for accurately setting decorative tiles with uniform grout lines and joints and, more particularly, to an adjustable tile spacing apparatus for efficiently setting a plurality of decorative tiles at a uniform and consistent width from adjacent decorative tiles.

2. Description of the Related Art

Anyone who has ever installed tile products before understands the aggravation associated with cutting and adjusting decorative tile, maintaining uniform grout lines and joints and conforming to a desired decorative pattern. A part of this pattern is the spacing between each piece that allows for placement of grout. Plastic spacers can be set to aid in this process, but they must be moved individually when the next piece is to be installed. Additionally, the plastic only allows for one dimension to be set at a time, thus multiple spacers must be set for just one more tile. This practice causes a user to juggle the tile and several spacers, and generally results in frustration, lost spaces, broken tile and irretrievable time. Furthermore, the plastic is difficult to clean, and will wear with time, thereby affecting grout line consistency. While these problems are difficult for the professional tile setter, they pose almost insurmountable problems for the do-it-yourself home owner.

Accordingly, a need has developed for a device that overcomes the problems associated with establishing consistent spacing when setting tiles on floors. The development of the adjustable tile spacing apparatus fulfills this need and provides an apparatus that accommodates placement of a plurality of decorative tiles while maintaining uniform grout lines.

A search of the prior art did not disclose any patents that read directly on the claims of the instant invention; however, the following references were considered related:

The following patents disclose a method for installing a laminated file: U.S. Pat. Nos. 5,401,343, 5,208,086 and 4,931,331, each issued in the name of Charles R. Owens;

The following patents describe a ceramic tile spacing gauge and tile holder U.S. Pat. No. 5,359,783 issued in the name of Smith; and U.S. Pat. No. 4,860,723 issued in the name of Fortin;

U.S. Pat. No. 5,667,190, issued in the name of Scott et al., discloses an object bracket holder for concrete forms, the bracket having a plurality of perimeter members that correspond to the outer edge of the object;

U.S. Pat. No. 5,062,913, issued in the name of Owens et al., describes a laminated tile product and method for producing the same, wherein the tile product comprises a sheet of natural stone having opposed first and second major surfaces and having a plurality of ceramic substrates having opposed first and second major surfaces;

U.S. Pat. No. 4,899,455, issued in the name of Bovino et al., discloses a tile squaring device having a distance rod, an anglehead and a sqaring means for connecting the anglehead to the distance rod so as to position the anglehead at a right angle to the distance rod;

U.S. Pat. No. 4,712,309, issued in the name of Kingston et al., describes an adjustable template for positioning tiles of various sizes; and U.S. Pat. No. 2,642,674, issued in the name of Schell, discloses an implement for laying square tile comprising a generally rectangular plate having a pair of straight edges spaced apart a distance equal to the width of a sized tile.

Consequently, a need has been felt for providing a device which allows tiles on floors to be set with greater ease and consistency in a manner which is quick and effective as well.

SUMMARY OF THE INVENTION

Therefore, it is an object of the present invention to provide an adjustable tile spacing apparatus which aids in setting decorative floor or wall tile and provides for perfect spacing between tiles.

It is another object of the present invention to provide a device which keeps grout lines consistent and establishes a consistent tile pattern.

It is still another object of the present invention to provide a device which can be used with most types of tile material.

It is still another object of the present invention to provide a device having an I-shaped frame for providing spacing at all four corners of tile.

It is another object of the present invention to provide a device having an I-shaped frame which is adjustable in both width and length dimensions to suit all sizes and types of tiles.

It is another object of the present invention to provide a device having a rubber handle for comfort.

It is another object of the present invention to provide spacers mounted on prongs from above a tile surface for providing the actual grout line spacing.

It is another object of the present invention to provide spacers supplied in "X", "L", "T", and linear shapes to allow installation of all tiles encountered.

It is another object of the present invention to provide spacers available in ¼ inch, ⅜ inch, and ⅛ inch varieties.

Briefly described according to the preferred embodiment of the present invention, an adjustable tile spacing apparatus is provided for setting tiles in a consistent pattern with perfect spacing relative to one another so as to obtain grout joints of uniform width. The invention comprises an I-shaped main frame which is adjustable in both width and length dimensions, via the use of telescoping members and fasteners. This adjustment allows the invention to work with most sizes of tile work. In each corner of the frame, a spacer is located. The spacer can be an X-shape, a T-shape, an L-shape, or a linear shape. These spacers would be used in setting field pieces, edge pieces, corner pieces, and variable pieces, respectively. The spacers would be available in ¼ inch, ⅜ inch, and ⅛ inch varieties to allow for the construction of various sized grout line widths. A rubber handle with finger grips is provided for user comfort. The invention is simply moved along as each tile is set and provides perfect spacing for the next tile to be set. The invention can be used with ceramic tile, clay tile, marble, slate, or virtually any material that is set with spacing for grout lines.

The use of the present invention allows decorative tiles on floors and walls to be set with greater ease and consistency and in a manner which is quick and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Figure 1:
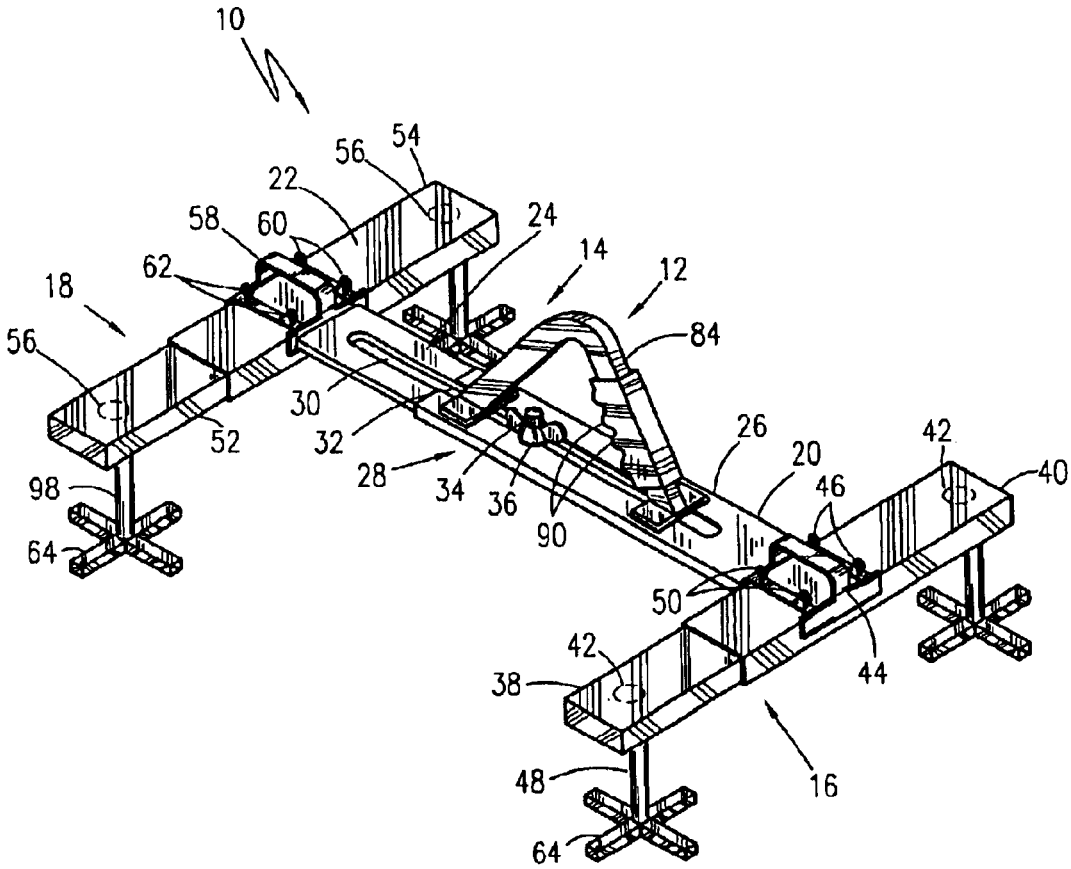
FIG. 1 is a perspective view of an adjustable tile spacing apparatus according to the preferred embodiment of the present invention, wherein width and length are adjustable via telescoping vertical members and a telescoping center member.

The best mode for carrying out the invention is presented in terms of its preferred embodiment, herein depicted within the FIGS. 1–7*d*.

1. Detailed Description of the Figures

Referring now to FIG. 1 through FIG. 4, an adjustable tile spacing apparatus 10 in accordance with a preferred embodiment of the present invention. The adjustable tile spacing apparatus 10 comprises an adjustable I-shaped main frame 12 which includes a telescoping center member 14 and two telescoping members 16 and 18, respectively, perpendicularly affixed to the center member 14 for laying tiles in a consistent pattern with perfect spacing relative to one another so as to obtain grout joints of uniform width.

It is envisioned that the present invention may be used with any material such as ceramic, marble, clay, and slate which is set with spacing for grout lines.

The center member 14 has an anterior end 20 opposite a posterior end 22 and includes a central inner member 24 telescoping inside a central outer member 26 for varying a horizontal length thereof so as to aid in accommodating tiles of all sizes. The central inner member 24 and the central outer member 26 have opened ends and are of a linearly elongated, hollow, rectangular configuration constructed of a material such as stainless steel or high strength aluminum.

Once a desired horizontal length of the center member 14 has been provided, the central inner member 24 and the central outer member 26 are held into their position via a locking assembly 28. The locking assembly 28 is designed so as to slidably engage both a linearly elongated void 32 formed along central outer member 26, and a linearly elongated void 34 formed along central inner member 24.

The locking assembly 28 includes a threaded bolt 34 inserted perpendicularly through a lower vertical sidewall of the central inner member 24 through the void 30 in the central inner member 24 and through the void 32 in central outer member 26.

The central inner member 24 and central outer member 26 are securely locked in the desired horizontal position by a fastener 36, such as a washer followed by a wing nut threadably received by the bolt 34 and tightened thereon. Various horizontal lengths of the center member 14 can be easily obtained, whereupon a user simply loosens the fastener 36 thus permitting the i central nner member 24 to be extended away from or retracted into the central outer member 26. The user then chooses the desired horizontal length, and locks the center member 14 in such position via the fastener 36.

A first perpendicular member 16 includes a first inner member 38 telescoping inside a first outer member 40. The first inner member 38 and the first outer member 40 are of a linearly elongated, hollow, rectangular configuration with open ends. The first outer member 40 includes a pair of orifices 42 formed along a lower sidewall thereof, wherein the orifices 42 are configured so that each may slidably receive a spacer receiving prong 48 (to be described in greater detail below).

The first outer member 40 further includes an H-shaped bracket 44 welded to opposing sidewalls thereof. A plurality of apertures 46 are formed along an upper surface of the bracket 44 so as to receive set screws 50 therethrough, the set screws 50 mechanically impinging a lateral width of the first perpendicular member 16 when the set screws 50 are threadably tightened against said first outer member 40. Various widths of the first perpendicular member 16 can be easily obtained, whereupon a user simply loosens the set screws 50 thus permitting the inner member 38 to be extended away from or retracted into the first outer member 40. The user then chooses the desired vertical length, and locks the first perpendicular member 16 in such position via the set screws 50.

A second perpendicular member 18 includes a second inner member 52 telescoping inside a second outer member 54. The second inner member 52 and the second outer member 54 are of a linearly elongated, hollow, rectangular configuration with open ends. The second outer member 54 includes a pair of orifices 56 formed along a lower sidewall thereof, wherein the orifices 56 are configured so that each may slidably receive a spacer receiving prong 98. The second perpendicular member 18 is positioned at an end of the center member 14 opposite to the first perpendicular member 16.

The second outer member 54 further includes an H-shaped bracket 58 welded to opposing vertical sidewalls thereof. A plurality of apertures 60 are formed along an upper surface of the bracket 58 so as to receive set screws 62 therethrough. Various lengths of the second perpendicular member 18 can be easily obtained, whereupon a user simply loosens the set screws 62 thus permitting the second inner member 52 to be extended away from or retracted into the second outer member 54. The user then chooses the desired vertical length, and locks the second perpendicular member 18 in such position via the set screws 62.

Each spacer receiving prong 48 or 98 is of a linearly elongated rectangular configuration welded at an upper end thereof to a lower sidewall at an end of inner members 38 and 52, opposite the outer members 40 and 54, and at ends of the outer members 40 and 54, opposite the inner members 38 and 52.

In order to facilitate the laying of tiles perpendicularly to each other for obtaining uniform and constant grout joints, spacers 64 are disclosed for being removably secured to a spacer receiving stem 66 of each spacer receiving prong 48.

Figure 5:
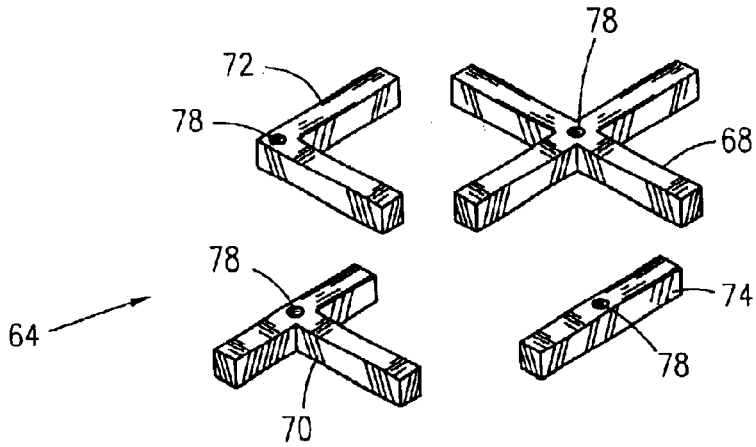
FIG. 5 is a perspective view of various spacers, including "L" shaped, "T" shaped, "X" shaped and "I" shaped spacers.

The spacers 64 are of a rectangular, hollow configuration, constructed of stainless steel, and are available in various shapes including but not limited to X-shape 68, T-shape 70, L-shape 72, and linear-shape 74 (as shown in FIG. 5). The spacers 64 are available in ¼ inch, ⅜ inch, and ⅛ inch varieties to allow for the construction of various sized grout line widths. The spacers 64 are used in setting field pieces, edge pieces, corner pieces and variable pieces.

The spacer receiving stem 66 is of a rectangular configuration welded to a lower end 76 of each spacer receiving prong 48 or 98, and extends vertically therefrom.

Figure 3:
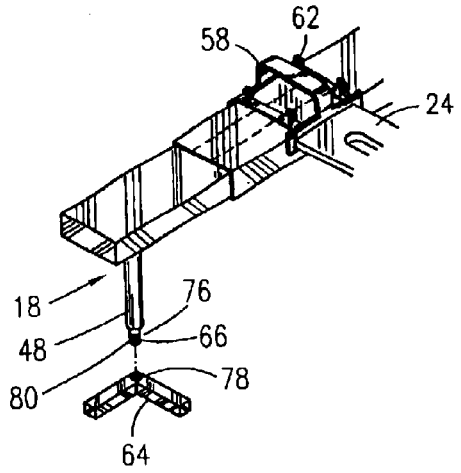
FIG. 3 is a partially exploded perspective view of the spacer receiving prong according to the preferred embodiment of the present invention.
Figure 4:
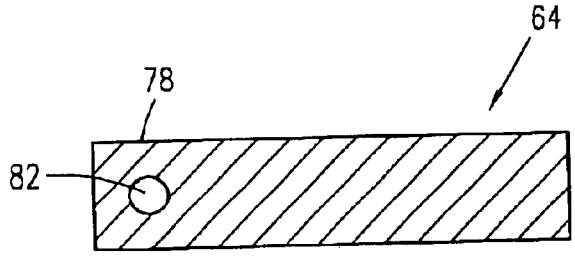
FIG. 4 is a cross-sectional view of a spacer according to the preferred embodiment of the present invention.

Referring now in greater detail to FIGS. 3 and 4, each spacer 64 includes a stem-receiving hole 78 formed on an upper sidewall thereof. The stem receiving hole 78 is designed so as to provide a snug fit when the spacer receiving stem 66 is inserted therein.

The spacer receiving stem 66 includes a spring-biased bead-like projection 80 located on a vertical sidewall thereof for being removably received by a corresponding bead receiving depression 82 formed on an inner wall within the hole 78 of each spacer 64 in order to provide a removably securable connection between the spacer receiving stem 66 and the stem receiving hole 78 of each spacer 64. After inserting the spacer receiving stem 66 within the hole 78, the bead receiving depression 82 receives the bead-like projection 80 of the spacer receiving stem 66, thereby biasing the spacer receiving stem 66 to a removably secured position within the hole 78. The spacer 64 can be removed by simply pulling the spacer 64 in a direction away from the spacer receiving stem 66 with sufficient force as is necessary so as to remove the bead-like projection 80 from within the depression 82. The connection and disconnection action of the spacer 64 is similar to that utilized with a typical ratchet tool.

Figure 2:
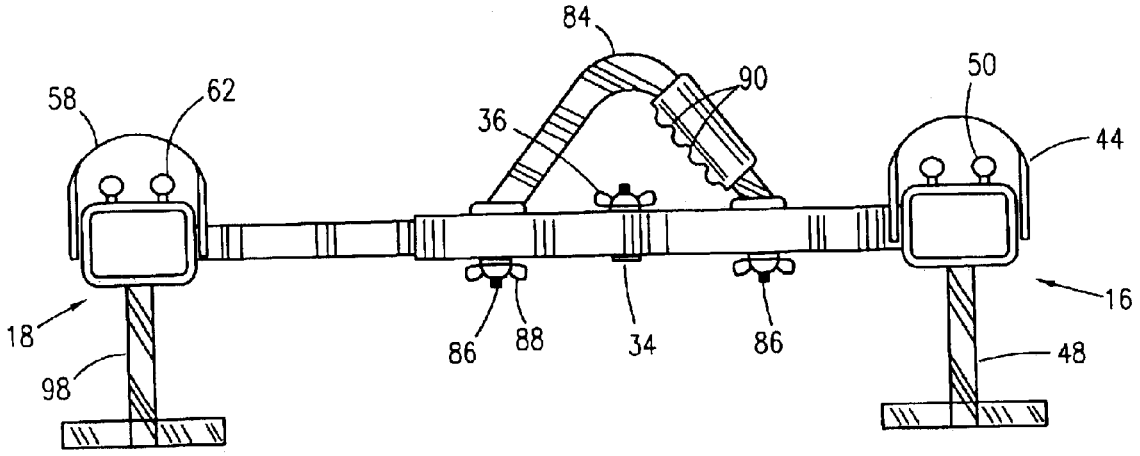
FIG. 2 is a side elevational view of the apparatus disclosed by FIG. 1.

Referring now to FIG. 1 and FIG. 2, a rubber handle 84 of a generally L-shaped configuration forms an angle of approximately 90°. The handle 84 includes a threaded prong bolt 86 welded vertically to an underside of each end thereof, and has a length extending through inner member 24 and outer member 26 so as to protrude thereunder. The handle 84 is securely locked in a desired horizontal position by a fastener 88, such as a washer followed by a wing nut threadably received by each bolt 86 and tightened thereon. Various horizontal lengths of the handle 84 can be easily obtained, whereupon a user simply loosens the fastener 88 thus permitting the handle 84 to be slidably adjusted in a horizontal direction. The user then chooses the desired horizontal position, and locks the handle 84 in such position via the fastener 88.

The handle 84 is further defined as having a plurality of finger-gripping channels 90 to allow a user to obtain a firm and comfortable grasp of the handle 84.

Figure 6:
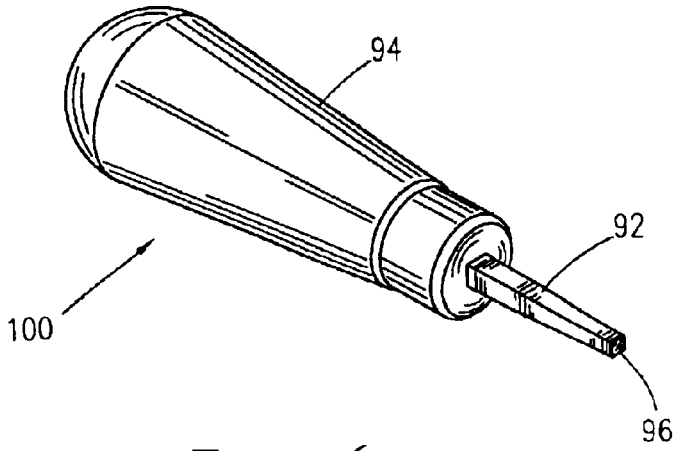
FIG. 6 is a perspective view of the linearly elongated handle, illustrating the features of the handle that permit use with the variously shaped spacers.

Referring now to FIG. 6, the spacers 64 are also adapted to be used with a linearly elongated handle 100, having a stainless steel, rectangular tip 92 for allowing a user to utilize a single spacer 64 upon the need arising. The rectangular tip 92 has lateral surfaces converging inwardly with increased distance from a rubber handle portion 94 of the handle 100. The rectangular tip 92 includes a spacer receiving stem 96 designed and configured identical to the spacer receiving stem 66 of each spacer receiving prong 48 so as to allow each spacer 64 to be removably secured to the spacer receiving stem 96 of the rectangular tip 92.

Being designed and configured so as to be horizontally and vertically adjustable, the present invention allows for the accommodation of tiles of most sizes.

Figure 7A:
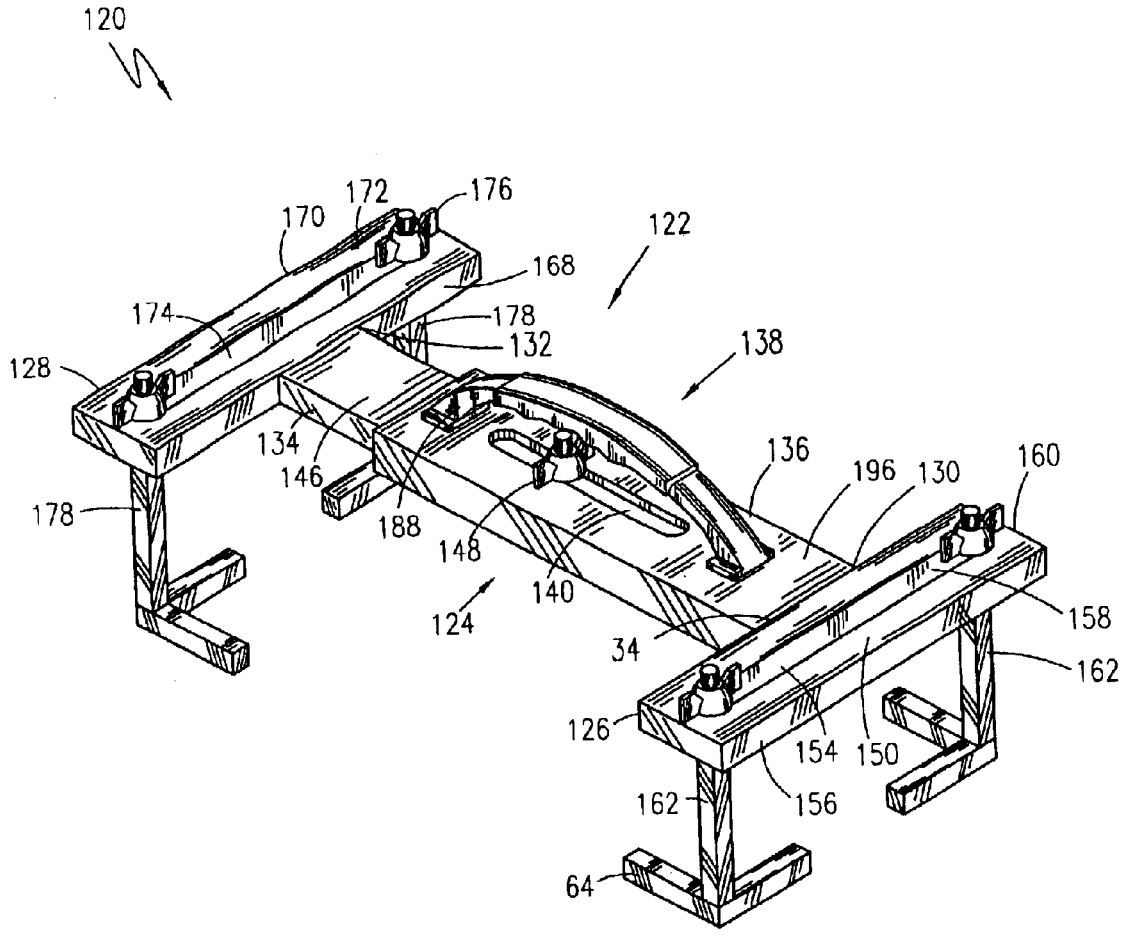
FIG. 7*a* is a perspective view of an alternative embodiment of the present invention, wherein width and length are adjustable, with the widths adjustable about vertical members having linearly elongated slots, and the length adjustable about a telescopic center member.
Figure 7B:
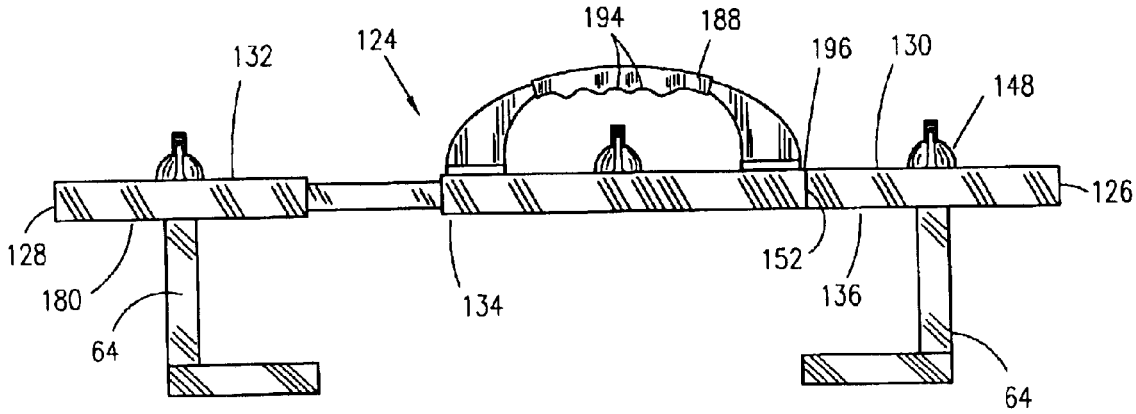
FIG. 7*b* is a side view of the alternative embodiment disclosed by FIG. 7*a;*
Figure 7C:
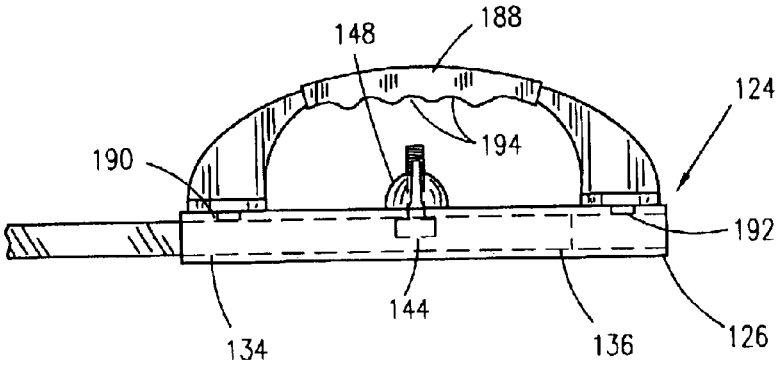
FIG. 7*c* is a side view of the handle portion of the alternative embodiment disclosed by FIG. 7*a* and FIG. 7*b*.

Referring now to FIG. 7*a* through FIG. 7*c*, an alternate embodiment of the present invention is shown. FIG. 7*a* illustrates a perspective view of the alternate embodiment of the adjustable tile spacing apparatus 120 comprising an I-shaped main frame 122 which includes a telescoping center member 124 and two perpendicular members 126 and 128 for laying tiles in a consistent pattern with perfect spacing relative to one another so as to obtain grout joints of uniform width.

The center member 124 has an anterior end 130 opposite a posterior end 132 and includes a central inner member 134 telescoping inside a central outer member 136 for varying a horizontal length thereof so as to aid in accommodating tiles of all sizes. The central inner member 134 and the central outer member 136 have opened ends and are of a linearly elongated, hollow, rectangular configuration constructed of a material such as stainless steel or high strength aluminum.

Once a desired horizontal length of the center member 124 has been provided, the central inner member 134 and the central outer member 136 are held into their position via a locking assembly 138. The locking assembly 138 is designed so as to slidably engage a linearly elongated slot 140 formed along an upper sidewall 142 of central outer member 136.

The locking assembly 138 includes a threaded bolt 144 welded perpendicularly along a linearly elongated centerline to an upper sidewall 146 of central inner member 134 which extends through the slot 140 in the central outer member 136.

The central inner member 134 and central outer member 136 are securely locked in the desired horizontal position by a fastener 148, such as a washer followed by a wing nut threadably received by the bolt 144 and tightened thereon. Various horizontal lengths of the center member 124 can be easily obtained, whereupon a user simply loosens the fastener 148 thus permitting the central inner member 134 to be extended away from or retracted into the central outer member 136. The user then chooses the desired horizontal length, and locks the center member 124 in such position via the fastener 148.

The first perpendicular member 126 is welded perpendicularly along a linearly elongated centerline of an inner sidewall 152 thereof to the outer member 136 at the anterior end 130 of the center member 124. The first perpendicular member 126 may be bolted or clamped to the central outer member 136; however, welding is the preferred method for permanent attachment. The first perpendicular member 126 is of a linearly elongated, hollow, rectangular configuration having a linearly elongated slot 158 formed along an upper sidewall 150 thereof, and a corresponding linearly elongated slot 154 formed along a lower sidewall 156 thereof, wherein the slots 154 and 158 are configured so as to slidably receive a prong bolt 160 from each of a pair of spacer receiving prongs 162 therethrough.

Each spacer receiving prong 162 is of a linearly elongated rectangular configuration which includes a threaded prong bolt 160 welded vertically to an upper end 164 thereof. The first vertical member 126 and the pair of spacer receiving prongs 162 are configured so as to provide various vertical settings, thereby aiding in accommodating tiles of most sizes.

Once a desired vertical setting has been provided, each spacer receiving prong 162 is held in such position by a fastener 148, such as a washer followed by a wing nut, threadably received by each prong bolt 160 and tightened thereon.

A second perpendicular member 128 is welded perpendicularly along a linearly elongated centerline of an inner sidewall 168 thereof to the inner member 134 at the posterior end 132 of the center member 124. The second perpendicular member 128 is of a linearly elongated, hollow, rectangular configuration having a linearly elongated slot 170 formed along an upper sidewall 172 thereof and a corresponding linearly elongated slot 174 formed along a lower sidewall 180 thereof, wherein the slots 170 and 174 are configured so as to slidably receive a prong bolt 176 from each of a pair of spacer receiving prongs 162 or 178 therethrough.

Figure 7D:
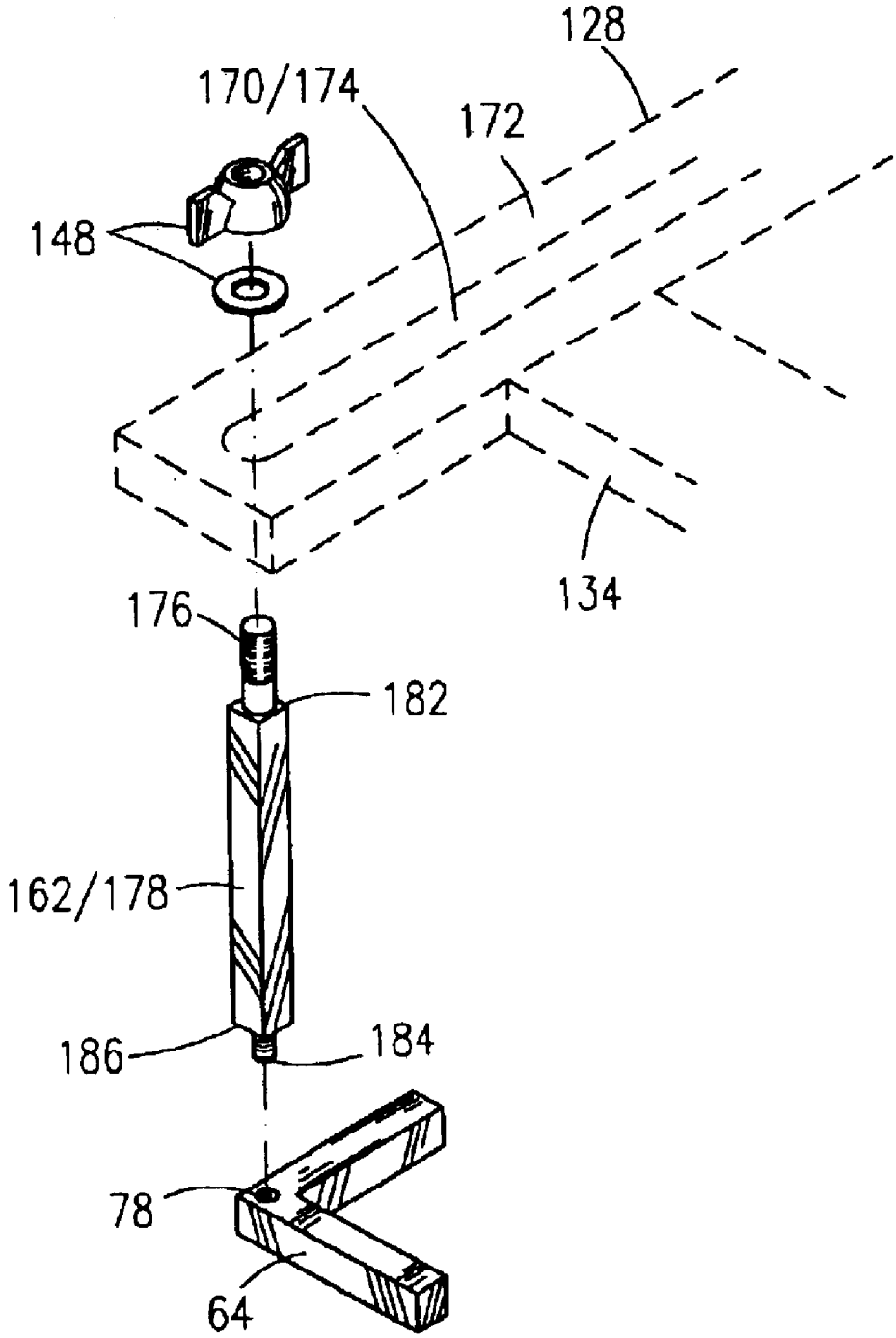
FIG. 7*d* is a partially exploded perspective view of an alternative embodiment illustrating a spacer receiver prong having a threaded bolt attached at an upper end and a stem attached at an opposite end, wherein the bolt inserts through a slot to provide lateral adjustment to the members, and the stem is inserted into a spacer.

Referring now to FIG. 7*d*, each spacer receiving prong 162 or 178 is of a linearly elongated rectangular configuration which includes a threaded prong bolt 176 welded vertically to an upper end 182 thereof. A spacer receiving stem 184 is of a rectangular configuration welded to a lower end 186 of each pair of spacer receiving prongs 162 or 178 respectively, and extends vertically downward therefrom. The second vertical member 128 and the spacer receiving prongs 162 or 178 are configured so as to provide various vertical and horizontal settings, thereby aiding in accommodating tiles of most sizes, wherein a loosened fastener 148 permits a threaded prong bolt 176 to slidably move within the linearly elongated slots 170 and 174.

The space receiving prongs 162 or 178 are configured to insert into the spacers 64 in a manner similar to that disclosed by FIG. 3 and to variously shaped spacers as disclosed by FIG. 5.

Referring back to FIG. 7*a*–FIG. 7*c*, a rubber handle 188, of an arcuate configuration, is mounted via brackets 190 and fasteners 192 parallel along a linearly elongated centerline of the central outer member 136, and lateral to ends of the slot 140. The handle 188 is further defined having a plurality of finger-gripping channels 194 to allow a user to obtain a firm and comfortable grasp of the handle 188. The arcuate configuration of the handle 188 creates a void between a lower surface thereof and the upper sidewall 196 of the central outer member 136, thereby allowing access by a user to horizontally adjust the center member 124.

2. Operation of the Preferred Embodiment

To use the present invention, the user removably secures a desired spacer 64 to each spacer receiving stem 66. The user then horizontally adjusts the center member 14, and vertically adjusts the first vertical member 16 and the second vertical member 18 for accommodating the desired tile for setting. The user securely locks the present invention in such position via the fastener 36 in order to lay tiles in a consistent pattern with perfect spacing relative to one another so as to obtain grout joints of uniform width. The invention is simply moved along as each tile is set and provides perfect spacing for the next piece of tile to be set.

The use of the present invention allows tiles on floors to be set with greater ease and consistency in a manner which is quick and effective.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. An adjustable tile spacing apparatus comprising:

a telescoping center member, said center member comprising an anterior end opposite to a posterior end, said center member including a central inner member telescopically communicating with a central outer member for varying a length of said center member;

a pair of adjustable perpendicular members, said pair of perpendicular members perpendicularly affixed to said center member at opposing ends, said pair of perpendicular members adjustable for varying a width of each said pair of perpendicular members;

a plurality of spacer receiving prongs, each of said plurality of spacer receiving prongs comprising a linearly elongated body, an upper end of said body affixed to a lower sidewall of said pair of perpendicular members, and a lower end affixed to a spacer, said spacer for providing a uniform joint line between tiles; and a handle, said handle affixed to said center member along a linearly elongated centerline of said center member.

2. The adjustable tile spacing apparatus of claim 1, wherein said central inner member and said central outer member are linearly elongated and hollow rectangular members comprising opened ends that telescopically communicate, said central inner member slidably inserted into and telescopically communicating with said central outer member.

3. The adjustable tile spacing apparatus of claim 2, wherein said central inner member and said central outer member further comprise linearly elongated voids formed within said central inner member and said central outer member, said voids aligned along a linearly elongated centerline of said center member.

4. The adjustable tile spacing apparatus of claim 3 further comprising a locking assembly, said locking assembly comprising a threaded bolt inserted through said voids formed within said central inner member and said central outer member, said threaded bolt secured by a threadable locking nut.

5. The adjustable tile spacing apparatus of claim 1, wherein said pair of adjustable perpendicular members comprises a first perpendicular member and a second perpendicular member.

6. The adjustable tile spacing apparatus of claim 5, wherein said first perpendicular member and said second perpendicular member each further comprise a pair of orifices, each said pair of orifices formed along a lower sidewall of said first perpendicular member and said second perpendicular member, each said pair of orifices configured so as to slidably receive a spacer receiving prong.

7. The adjustable tile spacing apparatus of claim 6, wherein said first perpendicular member comprises a telescoping first inner member and a telescoping first outer member, said first inner member and said first outer member are linearly elongated and hollow rectangular members comprising opened ends that telescopically communicate, said first inner member slidably inserted into and telescopically communicating with said first outer member.

8. The adjustable tile spacing apparatus of claim 7, wherein said first outer member further comprises a bracket affixed to sidewalls of said first outer member, said bracket comprising a plurality of apertures formed along an upper surface of said bracket, said plurality of apertures for receiving set screws therethough, said set screws mechanically impinging a lateral width of said first perpendicular member when said set screws are threadably tightened against said first outer member.

9. The adjustable tile spacing apparatus of claim 5, wherein said first perpendicular member is a linearly elongated and hollow rectangular member comprising a linearly elongated slot formed along a lower sidewall thereof, said slot configured to slidably insert a pair of prong bolts therein.

10. The adjustable tile spacing apparatus of claim 9, wherein said pair of prong bolts are slidably adjustable along a lateral width of said first perpendicular member, said pair of prong bolts slidably adjustable to accommodate various widths of tile.

11. The adjustable tile spacing apparatus of claim 10, wherein said pair of prong bolts are securely held in a desired position by fasteners, said fasteners threadably tightened about said pair of prong bolts.

12. The adjustable tile spacing apparatus of claim 5, wherein said second perpendicular member is a linearly elongated and hollow rectangular member comprising a linearly elongated slot formed along a lower sidewall thereof, said slot configured to slidably insert a pair of prong bolts therein.

13. The adjustable tile spacing apparatus of claim 12, wherein said pair of prong bolts are slidably adjustable along a lateral width of said second perpendicular member, said pair of prong bolts slidably adjustable to accommodate various widths of tile.

14. The adjustable tile spacing apparatus of claim 13, wherein said pair of prong bolts are securely held in a desired position by fasteners, said fasteners threadably tightened about said pair of prong bolts.

15. The adjustable tile spacing apparatus of claim 6, wherein said second perpendicular member comprises a telescoping second inner member and a telescoping second outer member, said second inner member and said second outer member are linearly elongated and hollow rectangular members comprising opened ends that telescopically communicate, said second inner member slidably inserted into and telescopically communicating with said second outer member.

16. The adjustable tile spacing apparatus of claim 15, wherein said second outer member further comprises a bracket affixed to sidewalls of said second outer member, said bracket comprising a plurality of apertures formed along an upper surface of said bracket, said plurality of apertures for receiving set screws therethough, said set screws mechanically impinging a lateral width of said second perpendicular member when said set screws are threadably tightened against said second outer member.

17. The adjustable tile spacing apparatus of claim 1, wherein said spacers comprise rectangular perimeters, said spacers having a shape selected from the group consisting of X-shape, T-shape, L-shape and linear shape.

18. The adjustable tile spacing apparatus of claim 17, wherein said spacers comprise the dimensions of between ⅛ inch up to ¼ inch.

19. The adjustable tile spacing apparatus of claim 1, wherein said handle is an L-shaped member affixed to said center member by a pair of threaded prong bolts and secured by a fastener, said handle comprising a plurality of finger-gripping channels so as to provide a comfortable grasp to said handle.

20. The adjustable tile spacing apparatus of claim 1, wherein said handle is an arcuate member affixed to said center member by a pair of brackets and fasteners, said handle comprising a plurality of finger-gripping channels so as to provide a comfortable grasp to said handle.

* * * * *